United States Patent [19]

Black

[11] Patent Number: 4,961,233

[45] Date of Patent: Oct. 9, 1990

[54] CYCLING PANTS

[75] Inventor: Graham Black, Monroe, Conn.

[73] Assignee: Cannondale Corporation, Georgetown, Conn.

[21] Appl. No.: 445,973

[22] Filed: Dec. 4, 1989

[51] Int. Cl.[5] ..... A41D 1/08

[52] U.S. Cl. ..... 2/228; 2/238; 2/272

[58] Field of Search ..... 2/228, 238, 401, 402, 2/403, 227, 255, 78 B, 78 C, 78 A, 78 R, 272, 408, 409, 406; 450/102, 103, 104

[56] References Cited

U.S. PATENT DOCUMENTS

| | | | |
|---|---|---|---|
| 2,232,246 | 2/1941 | Klein | 2/238 |
| 2,592,665 | 4/1952 | Deutsch et al. | 2/228 |
| 4,805,243 | 2/1989 | Gibbens et al. | 2/228 |
| 4,843,654 | 7/1989 | March | 2/228 |
| 4,850,056 | 7/1989 | Gardner et al. | 2/228 |
| 4,894,867 | 1/1990 | Ceravolo et al. | 2/228 |

*Primary Examiner*—William A. Cuchlinski, Jr.
*Assistant Examiner*—William C. Dowling
*Attorney, Agent, or Firm*—Brumbaugh, Graves, Donohue & Raymond

[57] ABSTRACT

The chamois of cycling pants is a single piece of fabric material free of seams and heat-formed to impart a generally form-fitting shape.

4 Claims, 2 Drawing Sheets

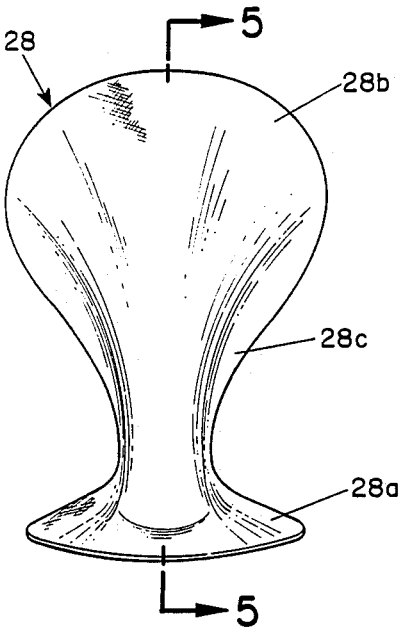
FIG. 3
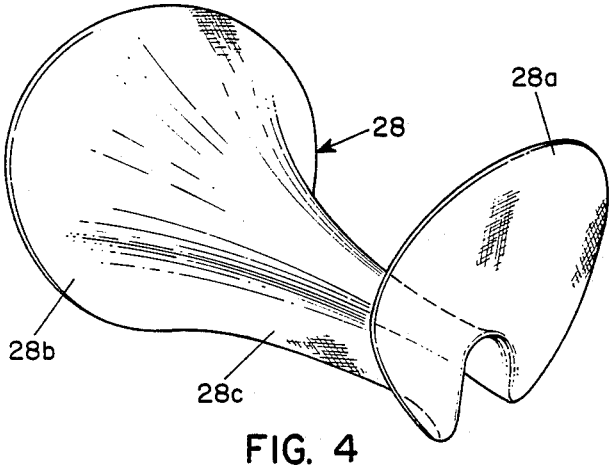
FIG. 4
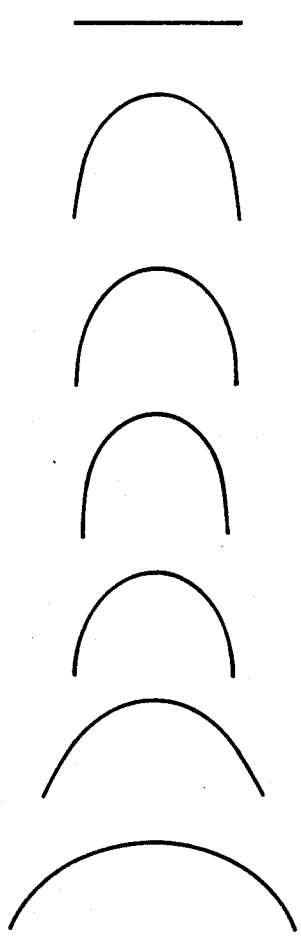
FIG. 6G
FIG. 6F
FIG. 6E
FIG. 6D
FIG. 6C
FIG. 6B
FIG. 6A
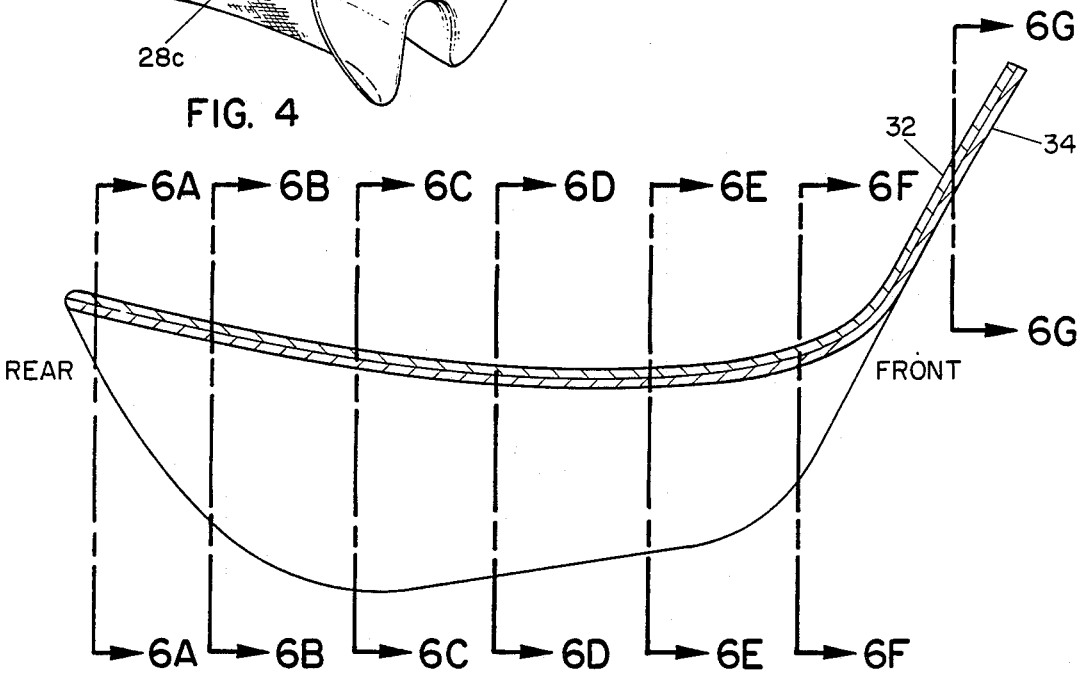
FIG. 5

CYCLING PANTS

BACKGROUND OF THE INVENTION

Many bicycling enthusiasts wear special cycling pants that are constructed for durability, cushioning between the seat and the cyclist, minimum chaffing of the cyclist and, oftentimes, minimum wind resistance. Cycling pants conventionally include a liner in the crotch and buttocks regions that has come to be generally known as a "chamois." [The term "chamois" is believed to be derived from the natural chamois material (sheep's skin leather) that is often used for the liner.]The chamois of cycling pants fits a part of the human anatomy that is of very complex shape. The lower abdomen is roughly vertically oriented; the perineal region is narrow, convexly curved downwardly antero-posteriorly, bounded by the upper, inner extremities of the thighs and widens both anteriorly and posteriorly; the lower buttocks curve posteriorly and upwardly, merge medially with the perineal region, and form junctures with the backs of the proximal thighs.

To provide reasonable conformity of the chamois with the anatomy, it has heretofore been required to fabricate it from several pieces of material, each configured to conform to a portion of the body, joined by stitching. For example, a conventional design consists of two side pieces, each having a wide rear part, a narrow center part and a wide front part, thus to roughly fit the medial borders of the buttocks, the upper medial extremities of the thighs and parts of the lower abdomen, and a triangular front piece to fit to the lower abdomen. The two side pieces are joined along a center seam along the rear and center parts, and the triangular front piece is joined to the front parts of the two side pieces by two seams forming a "V." This design only partly conforms to the body—the pieces are inherently flat, but the body has many curves. Therefore, the sewn chamois has a tendency to bunch up and crease and, therefore, cause some discomfort.

SUMMARY OF THE INVENTION

One objective of the present invention is to provide a chamois for cycling pants that more closely conforms to the shape of the body than do previously known chamois. Another object is to eliminate completely all seams and greatly reduce any tendency for bunching up and creasing, thereby providing a smooth and comfortable cushion, free of pressure points, between the bicycle seat and the rider.

The foregoing objects are achieved, according to the present invention, by a liner of a strong, soft, pliable, non-extensible fabric formed of webs of primarily thermoplastic fiber elements and stitched along its perimeter to the cycling pants. The liner consists of a front portion located in generally the lower abdominal region, a rear portion located in generally the buttocks region and a perineal portion located in the perineal region. As described thus far, the chamois conforms to conventional designs. Moreover, the fabric materials are used in previously known designs and include, for example, a synthetic leather-like material resembling natural chamois known as "Ultrasuede®" and a knitted polyester fleece.

The present invention is characterized in that the liner (chamois) is a single piece of a fabric material free of seams and heat-formed to impart a generally form-fitting shape in which the front portion curves sharply upwardly relative to the perineal portion, the rear portion and perineal portion are moderately concavely curved upwardly and both lateral margins curve downwardly, diverge anteriorly and posteriorly and diminish progressively in curvature in the front and rear portions.

In preferred embodiments, the invention is further characterized in that the piece of fabric material forming the liner is a laminate of a soft, smooth inner web that imparts abrasion resistance and a compressible outer web imparting cushioning. For example, the inner web may be a synthetic leather-like material and the outer web a synthetic fleece.

For a better understanding of the invention, reference may be made to the following description of an exemplary embodiment, taken in conjunction with the accompanying drawings.

DESCRIPTION OF THE DRAWINGS

FIG. 3 is a top plan view of the liner (hereinafter referred to as the "chamois");

FIG. 4 is a side three-quarter pictorial view (taken from above and the front) of the chamois as heat-formed to its body-conforming shape;

FIG. 5 is a side cross-sectional view of the chamois taken along the center line; and FIGS. 6A to 6G are transverse profile lines of the chamois taken at the correspondingly labelled section lines of FIG. 5.

DESCRIPTION OF THE EMBODIMENT

Figure 1:
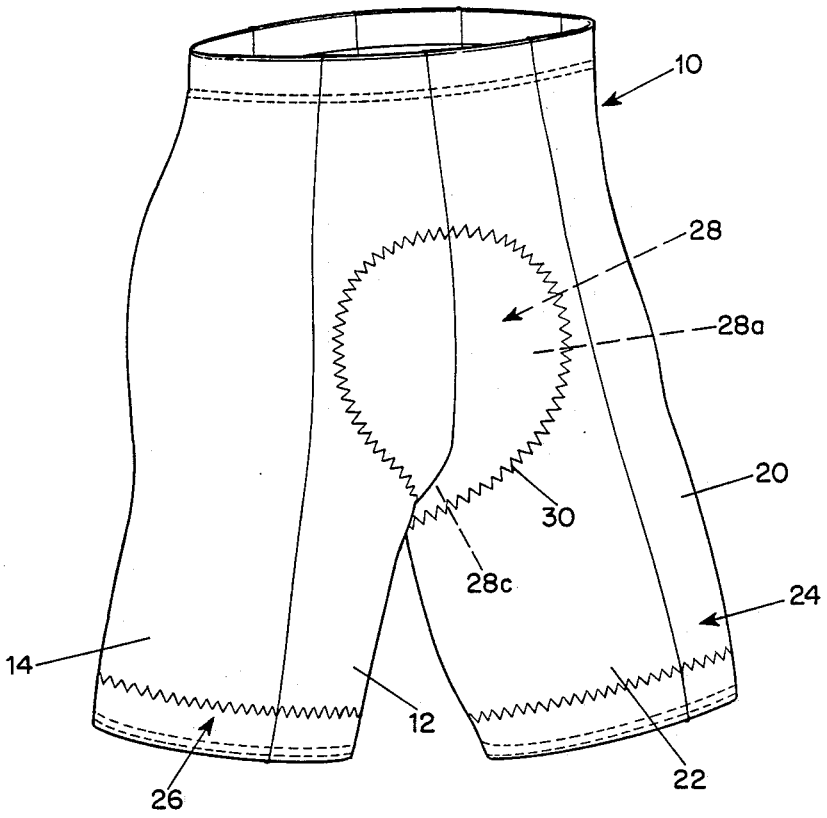
FIG. 1 is a front three-quarter pictorial view of cycling shorts embodying the invention.
Figure 2:
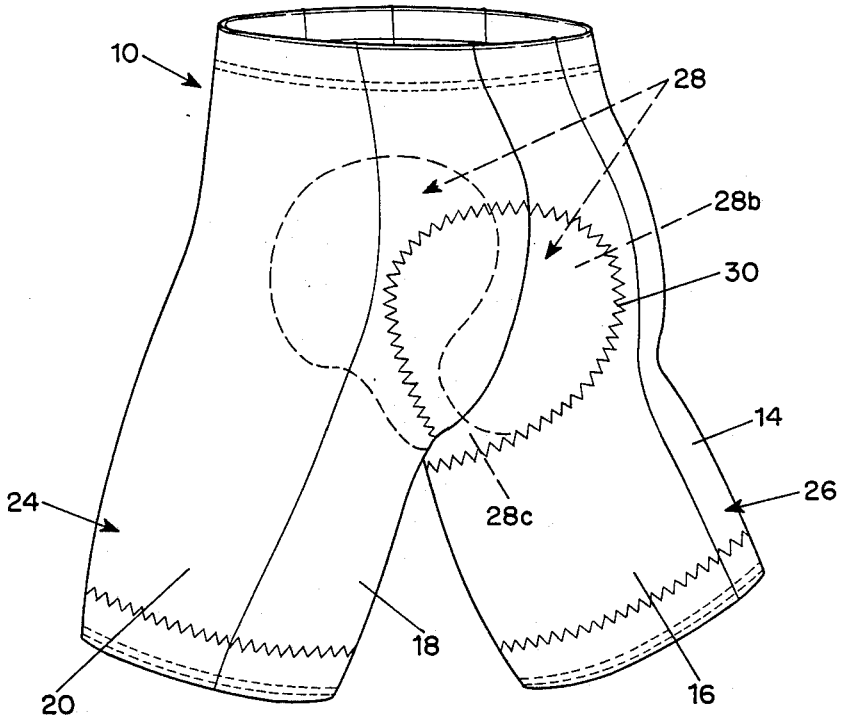
FIG. 2 is a rear three-quarter pictorial view of the cycling shorts of FIG. 1.

Except for the chamois, the cycling shorts 10 shown in FIGS. 1 and 2 are of conventional design. They are constructed by stitching together six carefully patterned, vertically-running pieces 12, 14, 16, 18, 20 and 22 of a stretch fabric. The use of several pieces provides excellent form-fitting for uniform stretching. Each leg 24, 26 has a gripper elastic band stitched at its hem to keep the leg tight and maintain an aerodynamic fit. Similarly, an elastic waist-band keeps the pants waist in place. The illustrated pants design is exemplary. The invention is equally applicable to other cuts of shorts (e.g., two-panel and eight-panel), to non-stretchable shorts, and to both stretchable and non-stretchable long pants.

As is conventional, per se, a chamois 28 is stitched by stitching 30 along its margin to the inside of the pants. The chamois includes a front portion **28*a* located in the lower abdominal region, a rear portion 28*b* located in the buttocks region and a perineal portion 28*c*** located in the perineal region. The upper margins of the front and rear portions are rounded, and the lateral margins of the front and rear portions converge toward generally the center of the perineal portion, which is the narrowest part of the chamois and corresponds to the part of the perineum where the thighs are closest together.

The chamois is made of a strong, soft, supple, nonextensible fabric material formed of primarily thermoplastic fiber elements. A preferred fabric material is a laminate (see FIG. 4) of a synthetic leather-like material 32 available commercially under the trademark "Ultrasuede®" and a knitted polyester fleece 34. The "Ultrasuede®" and polyester fleece are bonded in web-form by a suitable adhesive. The laminate is heat-formed to a body-conforming shape by holding a sheet cut from the laminate along its edges in a suitable tenter frame, heating the sheet to a temperature above its softening point but below the melting point and while it is hot molding it between molding dies having shapes conforming to the desired final shape. The softened laminate is stretched and deformed by the dies and is held in the dies long enough to allow the fabric to cool to a temperature below the softening point of the synthetic fibers. The formed chamois element is then cut from the fabric piece and over-edge stitched along the margin to stabilize the edge. The thus-completed chamois is sewn into the previously-finished pants with the "Ultrasuede ®" element facing inwardly while the pants are held stretched to approximately the same degree to which they are stretched when worn. Thus, when the finished pants are put on, the stretch material of the pants stretches to fit the wearer's body, and the chamois assumes its formed shape.

As best observed in FIGS. 4 to 6, the lateral margins of the chamois curve downwardly on either side (see FIG. 6D) so that they fit to the insides of the proximal thighs of the wearer. From approximately the center (FIG. 6D), the perineal portion widens both anteriorly and posteriorly and also has a progressively diminished lateral curvature toward the front and rear. The inverted transverse U-shape in the perineal part changes rapidly to a flat shape in the front portion for accommodation to the lower abdomen. The front portion also curves sharply upwardly relative to the perineal portion. The perineal portion and front portion are moderately concavely curved upwardly. In the region approximately between section lines 6F and 6G, the medial part of the chamois may, optimally, be given an inwardly and laterally concave shape (a cup-shape).

In the molding process, the principal regions of stretching are in the lateral margins of the perineal portion in order to provide the downward curvature laterally and upward curvature from front to back. Throughout most of its extent the chamois is permanently deformed to provide doubly curved surfaces for conformity to the wearer's anatomy. The object of the heat-forming is to shape the chamois so that it does not bunch up in the perineal region and conforms to the medial proximal thighs. Consequently pressure lines are eliminated, and chaffing is prevented; the chamois presents an entirely smooth, soft surface to the wearer's body in the zones of contact between the bicycle seat and the body.

Although both "Ultrasuede ®" and polyester fleece, as well as other materials useful in the present invention, are used in the chamois of previously marketed cycling pants, the heat formed, seamless chamois of the present invention eliminates the problems of chaffing and discomfort due to seams and to the bunching up of the chamois.

I CLAIM:

1. Cycling pants having a liner of a strong, soft, supple, non-extensible fabric material formed primarily of thermoplastic fiber elements and stitched along its perimeter to the pants, the liner consisting of a front portion located in generally the lower abdominal region, a rear portion located in generally the buttocks region and a perineal portion in the perineal region, characterized in that the liner is a single piece of material free of seams and heat-formed to impart a generally form-fitting shape in which the front portion curves sharply upwardly relative to the perineal portion, the rear portion and perineal portion are moderately concavely curved upwardly, and both lateral margins curve donwardly, diverge anteriorly and posteriorly and diminish progressively in curvature in the front and rear portions.

2. Cycling pants according to claim 1 and further characterized in that the piece of material is a laminate of a soft, smooth inner web imparting chaffing abrasion resistance and a compressible outer web imparting cushioning.

3. Cycling pants according to claim 2 and further characterized in that the inner web is a synthetic leather.

4. Cycling pants according to claim 2 and further characterized in that the outer web is a synthetic fleece.

* * * * *